US008470101B2

(12) United States Patent
Kobayashi et al.

(10) Patent No.: US 8,470,101 B2
(45) Date of Patent: Jun. 25, 2013

(54) LEAD-FREE COPPER ALLOY FOR CASTING WITH EXCELLENT MECHANICAL PROPERTIES

(75) Inventors: Takeshi Kobayashi, Settsu (JP); Toru Maruyama, Suita (JP); Ryozo Matsubayashi, Hikone (JP); Hiroyuki Abe, Nagahama (JP); Masakazu Teramura, Nagahama (JP)

(73) Assignees: Shiga Valve Cooperative, Shiga (JP); Biwalite Co., Ltd., Shiga (JP)

( * ) Notice: Subject to any disclaimer, the term of this patent is extended or adjusted under 35 U.S.C. 154(b) by 0 days.

(21) Appl. No.: 13/319,388

(22) PCT Filed: May 17, 2010

(86) PCT No.: PCT/JP2010/058292

§ 371 (c)(1),
(2), (4) Date: Nov. 8, 2011

(87) PCT Pub. No.: WO2010/137483

PCT Pub. Date: Dec. 2, 2010

(65) Prior Publication Data

US 2012/0082588 A1 Apr. 5, 2012

(30) Foreign Application Priority Data

May 26, 2009 (JP) ..... 2009-126918

(51) Int. Cl.
*C22C 9/04* (2006.01)
*C22C 9/10* (2006.01)

(52) U.S. Cl.
USPC ..... 148/434; 420/476

(58) Field of Classification Search
USPC ..... 148/434; 420/476
See application file for complete search history.

(56) References Cited

FOREIGN PATENT DOCUMENTS

| | | | |
|---|---|---|---|
| JP | 2006-152373 | | 6/2006 |
| JP | 2006152373 A | * | 6/2006 |
| JP | 3957308 | | 5/2007 |
| JP | 2007-297675 | | 11/2007 |
| JP | 2007297675 | * | 11/2007 |

OTHER PUBLICATIONS

Sokeizai, issued by Sokeizai Center, Aug. 2003, pp. 7-14, with partial English translation of p. 9, lines 5-20, right column.
Kobayashi et al., "Lead Free Copper Alloy for Castings", Materia Japan, vol. 43, No. 8, 2004, pp. 647-650, with partial English translation of p. 647, lines 5-20, right column.
International Search Report issued Aug. 10, 2010 in corresponding International Application No. PCT/JP2010/058292, of record.

* cited by examiner

*Primary Examiner* — Sikyin Ip
(74) *Attorney, Agent, or Firm* — Wenderoth, Lind & Ponack, L.L.P.

(57) ABSTRACT

Disclosed is a lead-free copper alloy for casting which contains 0.1-0.7% of S, 8% or less (excluding 0%) of Sn, and 6% or less (excluding 0%) of Zn, and in which a sulfide is dispersed and the average spheroidization ratio of the sulfide is 0.7 or greater. Due to this constitution, said lead-free copper alloy for casting has excellent mechanical properties such as strength, high pressure resistance and good machinability and, therefore, is useful as a starting material for faucet metal fittings, water faucet and so on, even though the alloy contains no lead which causes deterioration of water.

2 Claims, 9 Drawing Sheets

LEAD-FREE COPPER ALLOY FOR CASTING WITH EXCELLENT MECHANICAL PROPERTIES

CROSS-REFERENCE TO RELATED APPLICATIONS

This application is a continuation application of International Application PCT/JP2010/058292, filed May 17, 2010, designating the U.S., and claims the benefit of priority from Japanese Patent Application No. 2009-126918, filed on May 26, 2009, the entire contents of which are incorporated herein by reference.

TECHNICAL FIELD

The present invention relates to copper alloy for casting with excellent mechanical properties, especially the lead-free copper alloy for casting with excellent mechanical properties, such as strength, high pressure resistance and good machinability, even though the alloy contains no lead which causes deterioration of water.

BACKGROUND ART

Copper alloys have widely been used for materials for a variety of articles such as electric parts because of their excellent properties of electrical conduction and heat conduction. Regarding the copper alloys for casting, various kinds of the copper alloys are standardized in JIS H5120 for a variety of articles such as a valve body, a faucet and a bearing.

The copper alloys for casting are generally used for the faucets of water and sewerage, and for a valve for general plumbing. In particular, in the alloys standardized by JIS H5120, brasses (Cu—Zn system alloy) such as CAC203 of the copper alloy, and bronzes such as CAC403 (Cu—Sn—Zn system alloy) and CAC406 (Cu—Sn—Pb—Zn system alloy) are materials for the articles.

In the case to be used for the faucet and the valve as described above, good properties such as high pressure resistance, wear resistance, castability, mechanical properties (strength and hardness), and machinability are required. Lead (Pb) is commonly contained as the way of improving machinability of the copper alloy, and the machinability of the CAC406 of the above copper alloy for casting is improved as the result of containing lead of about 4-6%, by mass. In addition, it is known that the pressure resistance is also improved by containing lead (ex. NONPATENT LITERATURE 1).

On the other hand, water pollution is caused by dissolving lead into drinking water if a variety of articles such as the faucet and the valve is made by the copper alloy containing lead for casting, and it has been pointed out that the polluted water has harmful effect to a human body. In particular, the regulation of lead in water quality-based limitations was increased by ⅕ of the former value, and the regulation for using lead in the copper alloy for casting used for the articles such as the faucet and the valve has become strict.

Therefore, many kinds of copper alloy for casting improved in machinability have been proposed even though lead is not added into the copper alloys. The copper alloys containing bismuth and/or selenium to improve machinability were developed in western countries, and the alloys have been standardized in CDA (Copper Development Association) (ex. NONPATENT LITERATURE 2). The copper alloy containing Sb with Bi is also known (above NONPATENT LITERATURE 1).

These copper alloys contain Bi, Se and Sb as an element for free cutting instead of lead, and, by the development of the technology, good machinability is provided without the harm of lead.

However, the further improvement of the developed lead free copper alloys is required because the pressure resistance of the alloys can be degraded rather than the conventional standardized copper alloy, due to common occurrence of porosity as casting defect. On the other hand, there are problems in point of views of raw materials and resources because Bi and Se are rare metals (small amount of deposit). The copper alloy having better mechanical properties such as strength and elongation than the conventional leaded copper alloy for casting has never developed.

PRIOR ART DOCUMENTS

Nonpatent Documents

NONPATENT LITERATURE 1: Materia Japan, vol. 43, No. 8 (2004), p. 647-650.

NONPATENT LITERATURE 2: Sokeizai, August, (2003), issued by SOKEIZAI CENTER, p. 7-14.

SUMMARY OF THE INVENTION

Problems to be Solved by the Invention

It is an object of the present invention to provide, for casting materials for the articles such as the faucet and the valve, a lead free copper alloy which does not contain lead to pollute water, and is quite excellent in mechanical properties such as strength, pressure resistance, and machinability.

Means of Solving the Problems

The above object of the present invention is achieved by the main point that the lead free copper alloy for casting contains 0.1-0.7 mass % of S, 8% or less (excluding 0%) of Sn, and 6% or less (excluding 0%) of Zn, with the dispersion of a sulfide of which the average spheroidization rate of the sulfide is 0.7 or greater. The other constituents (the remains) in the above alloy are copper and elements of the basic constituent unavoidable impurities. "The average spheroidization rate" as described above is the average value of degree of difference between a true circle and a circularity of the sulfide with a prescribed size range. The way to measure the value will be described later.

In the lead free copper alloy of the present invention, the machinability becomes good by the satisfying an important matter that 70% or more of the area fraction of the copper sulfide in all sulfides is preferred.

Effects of the Invention

In the present invention, as the result of the exact definition of the content such as S, Sn, and Zn, an appropriate degree of the spherical sulfide in the copper matrix can be dispersed efficiently, and the lead free copper alloy for casting has excellent mechanical properties such as strength, and also has excellent properties such as high pressure resistance, and good machinability even though the alloy contains no lead which causes deterioration of water. This copper alloy is of service as a material for the articles such as the faucet and the valve. Any resource problems are not incurred because, in the present invention, S, Sn and Zn as resource-rich element are basically used as the substitute element of Pb.

MODE FOR CARRYING OUT THE INVENTION

Figure 1:
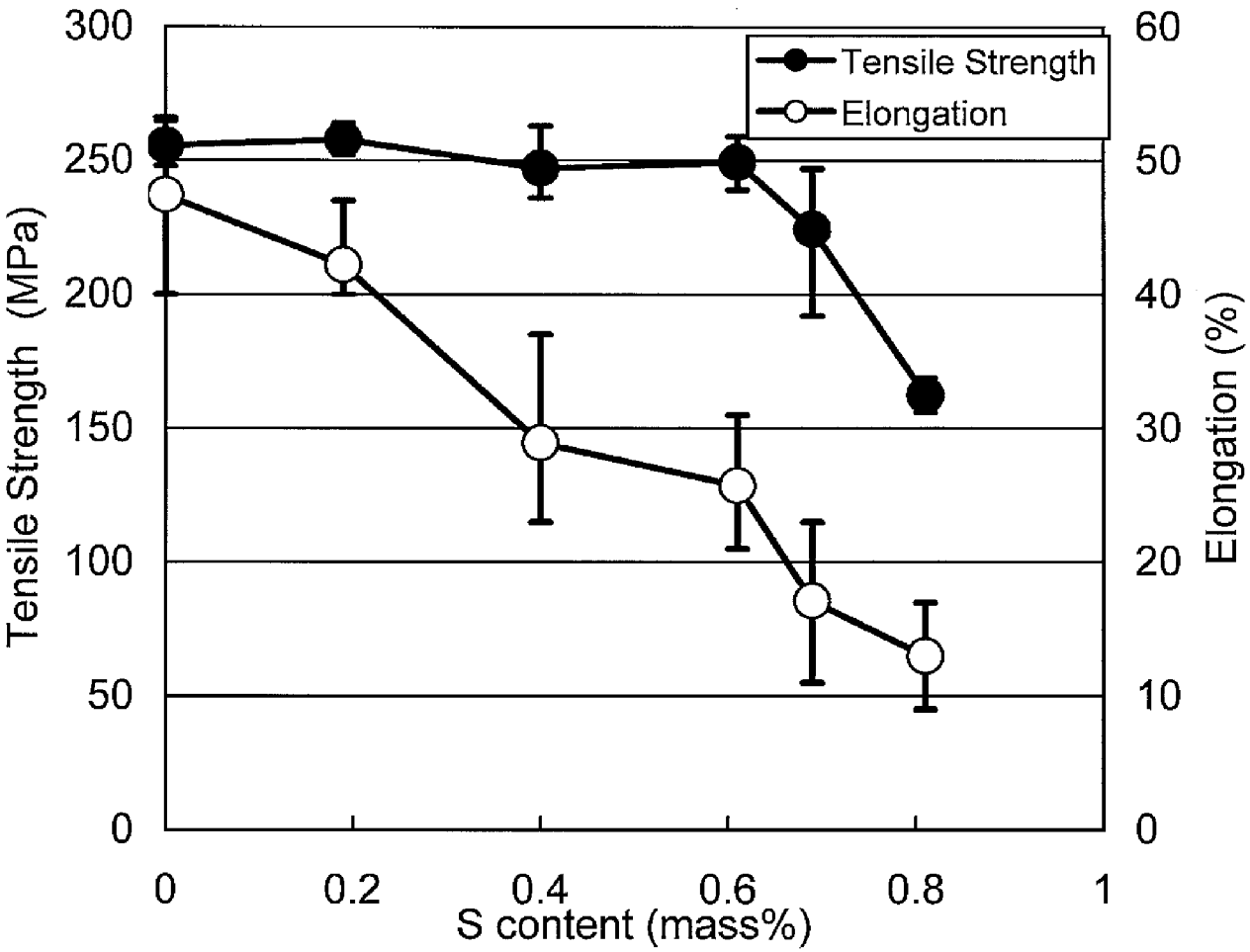
[FIG. 1] It is the graph showing relationship between the sulfur content in the copper alloy and the mechanical property.

The inventors have studied on a copper alloy for casting to show excellent properties even though the alloy contains no lead. As part of the study, it was found that the pressure resistance and the machinability became good in the copper alloy with sulfide formed and dispersed in the metallic structure, and containing sulfur (S) as an essential component with additions of Fe and/or Ni by controlling range of the appropriate content, and the previous invention was applied because the technical value was recognized (Japanese Patent No. 3957308).

In the above technology, a certain amount of Fe and Ni is added together in order to disperse sulfur, which is an element improving the machinability, as sulfide in copper matrix. As the achievement of this technology, these copper alloys have good mechanical property and good pressure resistance as the result of inhibition of formation of casting porosity due to efficient dispersion of sulfide in the copper matrix.

The inventers have advanced the research on an improvement of property of copper alloy after the achievement of the above technology. As the result, the invention is achieved since it is found that the copper alloy for casting having excellent mechanical properties such as strength, and having excellent properties such as high pressure resistance, and machinability can be made even though the alloy contains no Fe and no Ni and so on, because the appropriately spherical sulfide is dispersed in a Cu—S—Sn—Zn system alloy containing S in a certain limited range.

Dendrites form during solidification of the copper alloy for casting, and porosity (gas) forms at the interdendrite during the period of the end of solidification. It is known that casting defect forms as a result of the formation of the porosity. In the case of the copper alloy proposed before, sulfide exists as eutectic melt even just before the end of solidification because the formation of sulfide is controlled until relatively low temperature by the coexistence of Fe, Ni and S. And, the sulfide forms after the eutectic melt flows into the porosity which can be casting defect. It was considered that mechanical properties, for example strength and pressure toughness are improved because the casting defect decreases as the result. It was considered that machinability is improved because the sulfide acts as lubricant and chip breaker, which cuts off the cutting chips and the cutting chips become fine, as the result that the sulfide is dispersed at interdendrite in the form of eutectic structure or fine structure. In the case of the copper alloy proposed before, Fe and Ni are added in order to achieve the effect efficiently.

However, through the examination by the inventers, the state is achieved that the appropriate spherical sulfide is dispersed if the content of S is in certain range, even if Fe and Ni are not added. And mechanical properties, pressure toughness, and machinability are improved by the achievement of the state.

S, Sn and Zn are contained as essential element in the lead free bronze for casting. The reasons of narrow down of the content range as follows:

S is a useful element to form copper sulfide and zinc sulfide ($Cu_2S$ and ZnS) to improve good pressure toughness and machinability. In order to achieve the improvement, 0.1% of S is needed at least. However, the mechanical properties (tensile strength and elongation) decreases if S content is larger than 0.7% because the amount of eutectic or flake sulfide increases and the amount of spherical sulfide decreases (FIG. 1 as shown later). Therefore, S should be 0.7% or lower. The favorable lower limit of S is 0.2%, and the favorable higher limit of S is 0.6%.

Sn is an effective element for improving mechanical properties, such as the tensile strength and the elongation. Although the larger the content is, the larger the effects is, the content should be lower than 8% in consideration of economic efficiency. The favorable lower limit of Sn is 1.0%, and the favorable higher limit of S is 6.0%.

Zn is an effective element for improving mechanical properties, such as the tensile strength and the elongation. Zn improves pressure toughness by formation of ZnS. In order to achieve the improvement, it is favorable to contain 1% or larger. However, if the zinc content is too much, the interface energy between copper alloy melt and sulfide becomes low, and the sulfide shape becomes flaky or eutectic, and machinability is lead to decrease (FIGS. 4, 5, and 7 as shown later) .Therefore, the zinc content should be lower than 6%, and the favorable content is 3% or lower.

The basic composition of the invented copper alloy is as described above, and the remaining elements are copper (Cu) and unavoidable impurities. The unavoidable impurities are, for example, Pb, Sb, P, Fe, Ni, etc. In the impurities, Pb content is preferably 0.25% or lower from a point of view of lead free alloy. The Fe content is preferably 0.5% or lower, and Ni content is preferably 1.0% or lower because of the point of view not to decrease toughness. The Sb content is preferably 0.2% or lower, and P content should be 0.05% or lower.

Figure 6:
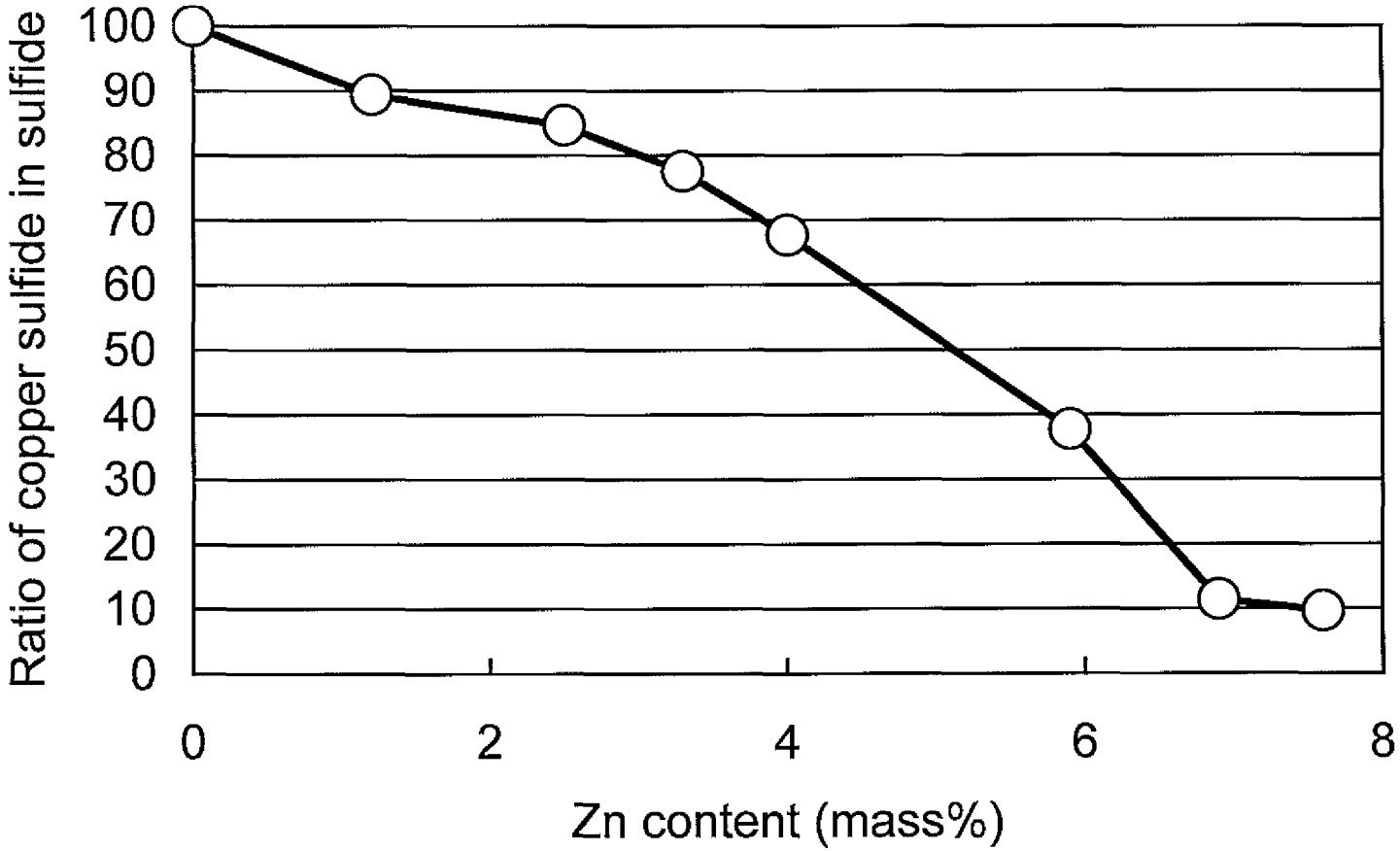
[FIG. 6] It is the graph showing relationship between the zinc content in the copper alloy and the ratio of copper sulfide in all sulfides.

In the invented copper alloy, the effects as described above are provided as the result that the spherical sulfide of the predetermined ratio is dispersed in a metallographic structure (copper matrix). S, Sn and Zn of the appropriate content of are melted and solidified, and the sulfide is formed naturally. The favorable copper sulfide ratio in the sulfide is 70% or larger (as shown in FIG. 6 later) for the reason of machinability. The invented copper alloy can be cast by processes of sand mold casting, permanent mold casting, centrifugal casting and investment casting, as conventional processes.

Examples of the present invention are described more as follows. The invention is not limited to the following examples, and the technical scope of the invention also includes any design variations by using the points described above and below.

EXAMPLE

Example 1

Each copper alloy shown in Table 1 below was melted and cast by a common procedure. The mechanical properties (tensile strength and elongation) of the copper alloy castings are examined. In Table 1, the values (contents) of each element except S were measured by the X-ray fluorescence spectrometer (Element Analyzer, JSX-3202, made by JEOL Ltd.). S content was measured by a combustion method. The values in Table 3 and Table 5 were also measured by the same ways. The average spherical ratio of the sulfide and the ratio of copper sulfide in all sulfides (area fraction of copper sulfide in all sulfides) were measured by procedures as follows.

"Procedure to Measure the Average Spherical Ratio of Sulfide"

Circularity of each sulfide, which is larger than 2.5 μm of diameter, observed by an optical microscope with a magnifier of 100 times was measured. The circularity means the ratio of the diameters of the major diameter of the sulfide observed in the microscope and the diameter of the true circle having same area as the sulfide (the diameter of the true circle/the major diameter). The circularities in six views (one view is 0.64 mm×0.48 mm) of microstructure were measured, and the average spherical ratio was defined as the average of the circularities. For example, the spherical ratio (the circularity) is 1.0 (100%) if measured sulfide is true circle.

"Procedure to Measure the Aria Fraction of Copper Sulfide in all Sulfides"

15 views (one view is 0.128 mm×0.096 mm) by an optical microscope with a magnifier of 500 times were measured, and the total area of sulfide, which is larger than 2.5 μm of diameter, was measured. The total area of ZnS (dark gray area was identified as ZnS) was also measured, and the total area of copper sulfide was a value subtracted the total area of ZnS from the total area of sulfide. From these values, the area fraction of copper sulfide in all sulfides (average) was calculated.

TABLE 1

| | Chemical composition (mass %) | | | | | | | | |
|---|---|---|---|---|---|---|---|---|---|
| No. | Sn | Zn | Pb | Ni | Fe | P | Sb | S | Cu |
| 1 | 3.4 | 2.6 | <0.02 | <0.01 | 0.02 | 0.02 | <0.02 | <0.001 | Remainder |
| 2 | 3.5 | 2.6 | <0.02 | <0.01 | 0.04 | 0.03 | <0.02 | 0.19 | Remainder |
| 3 | 3.4 | 2.8 | <0.02 | <0.01 | 0.06 | 0.03 | <0.02 | 0.40 | Remainder |
| 4 | 3.4 | 2.6 | <0.02 | <0.01 | 0.10 | 0.04 | <0.02 | 0.61 | Remainder |
| 5 | 2.8 | 2.3 | <0.02 | 0.95 | 0.03 | 0.04 | <0.02 | 0.69 | Remainder |
| 6 | 2.8 | 3.3 | <0.02 | 0.88 | 0.27 | 0.03 | <0.02 | 0.81 | Remainder |

Figure 2:
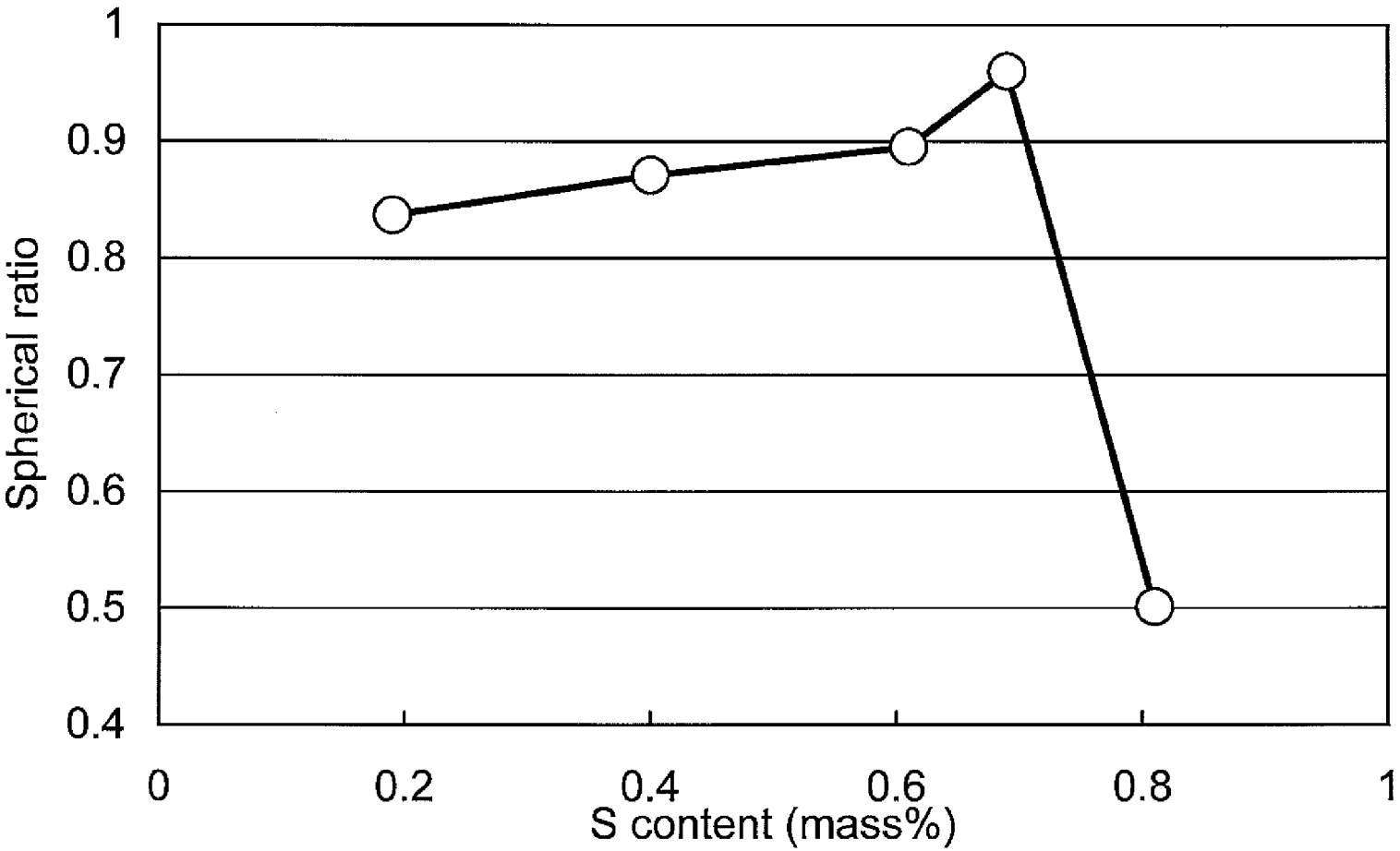
[FIG. 2] It is the graph showing relationship between the sulfur content in the copper alloy and the spherical ratio.

The measured results (average of 2 results: n=2) were shown in Table 2. The relationship between S content and mechanical properties (tensile strength and elongation) of each copper alloy shown in Table 1 is shown in FIG. 1, and the relationship between S content and the spherical ratio (the average spherical ratio) is shown in FIG. 2. The tensile strength and the elongation of the CAC406 as a conventional leaded bronze are 195 MPa and 15% (these values were referred from JIS), respectively.

TABLE 2

| No. | Tensile strength (MPa) | Elongation (%) | Average spherical ratio (—) | Area fraction of copper sulfide (%) |
|---|---|---|---|---|
| 1 | 255.6 | 47.4 | 0.88 | — |
| 2 | 257.8 | 42.2 | 0.79 | 61.9 |
| 3 | 247.1 | 28.9 | 0.82 | 67.5 |
| 4 | 249.3 | 25.7 | 0.81 | 73.0 |
| 5 | 224.3 | 17.1 | 0.79 | 85.5 |
| 6 | 162.4 | 13.0 | 0.57 | 72.6 |

It is considered from these results as follows. In 0.1-0.7% of S content, the tensile strength is larger than that of the conventional bronze (CAC406), and the spherical ratio becomes large. The elongation is comparable to the conventional bronze. In S content larger than 0.7%, however, the mechanical properties decrease with increasing S content, and the spherical ratio also tents to decrease. In each invented copper alloy (No. 2-5), it is confirmed that sulfides are dispersed in the region of the final solidification by the observation by an optical microscope.

Example 2

The machinability of each copper alloy casting shown in Table 1 above was examined. The cutting conditions are as follows. The sample was machined from 23 mm, 22mm, and to 21 mm of diameter, and the cutting resistance was measured when the sample was machined to 20 mm of diameter. The machinability was evaluated as a cutting index calculated by equation (1) below.

[Cutting Conditions]

Numerical control lathe: OKUMA LP25C (Okuma Co, Ltd.)

Tip: IGETALLOY (Sumitomo Electric Hardmetal Co, Ltd.)

Cutting power measuring machine: KISLER9257B (Kistler Japan Co., Ltd.)

Cutting oil: Oiliness

Cutting rate: 100 m/min

Feed rate: 0.1 mm/rev

Cutting depth: 0.5 mm and 1.0 mm

Diameter of original specimen: 23 mm

Diameter of specimen for cutting: 20 mm $$\text{Cutting coefficient} = (\text{Cutting resistance of CAC406} / \text{Cutting resistance of each specimen}) \times 100 \quad (1)$$

Figure 3:
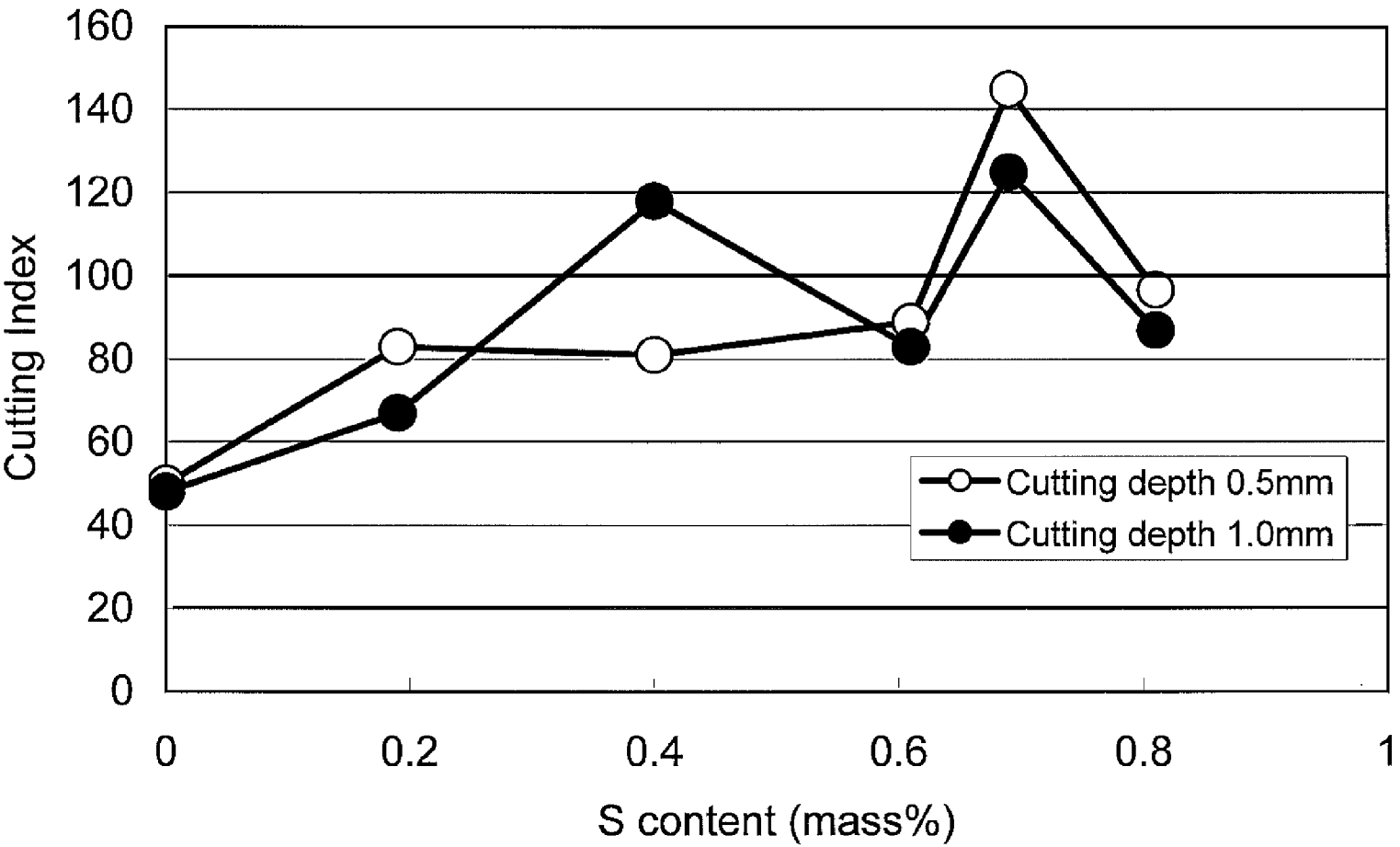
[FIG. 3] It is the graph showing relationship between the sulfur content in the copper alloy and the machinability (cutting coefficient).

The result (the relationship between S content and the cutting coefficient) is shown in FIG. 3. As evidenced by the result, the machinability improves with increasing S content. It is considered for the reason that the spherical sulfide is dispersed homogeneously.

Example 3

The pressure toughness of each copper alloy casting shown in Table 1 above was examined. According to the standard of "9.1 Pressure toughness test for valve case" in "JIS B 2062, valve for drinking water", the pressure toughness test (condition of water pressure: 3 MPa for 2 min) was carried out. 24 times (n=24) of the test were carried out for every specimen, and water leak was checked with naked eye. If the leak was found in a specimen, the specimen was determined as defective specimen, and the pressure toughness was evaluated as the detection ratio (defective fraction=number of leaked specimen/24).

As the results, good pressure toughness was confirmed because the defective ratio is extremely low (0%) in the copper alloy of No. 2-5 shown above. It is considered for the reason that the spherical sulfide is dispersed homogeneously.

Example 4

Each copper alloy (No. 7-14) shown in Table 3 below was melted and cast by a common procedure. The mechanical properties (tensile strength and elongation), the sulfide spherical ratio and the copper sulfide ratio of the copper alloy castings were examined by the same way as example 1. The cutting index was also examined by the same way as example 2.

TABLE 3

| | Chemical composition (mass %) | | | | | | | | |
|---|---|---|---|---|---|---|---|---|---|
| No. | Sn | Zn | Pb | Ni | Fe | P | Sb | S | Cu |
| 7 | 3.1 | <0.05 | <0.05 | 1.0 | <0.02 | <0.01 | <0.02 | 0.46 | Remainder |
| 8 | 3.5 | 1.2 | <0.05 | 0.97 | 0.01 | 0.04 | <0.02 | 0.45 | Remainder |
| 9 | 3.3 | 2.5 | <0.05 | 0.98 | 0.04 | 0.04 | <0.02 | 0.44 | Remainder |
| 10 | 3.3 | 3.3 | <0.05 | 0.95 | 0.02 | 0.03 | <0.02 | 0.43 | Remainder |
| 11 | 3.2 | 4.0 | <0.05 | 0.90 | 0.03 | 0.04 | <0.02 | 0.45 | Remainder |
| 12 | 3.3 | 5.9 | <0.05 | 1.0 | 0.10 | 0.05 | <0.02 | 0.45 | Remainder |
| 13 | 3.2 | 6.9 | <0.05 | 0.97 | 0.17 | 0.05 | <0.02 | 0.45 | Remainder |
| 14 | 3.3 | 7.6 | <0.05 | 1.0 | 0.13 | 0.05 | <0.02 | 0.46 | Remainder |

Figure 4:
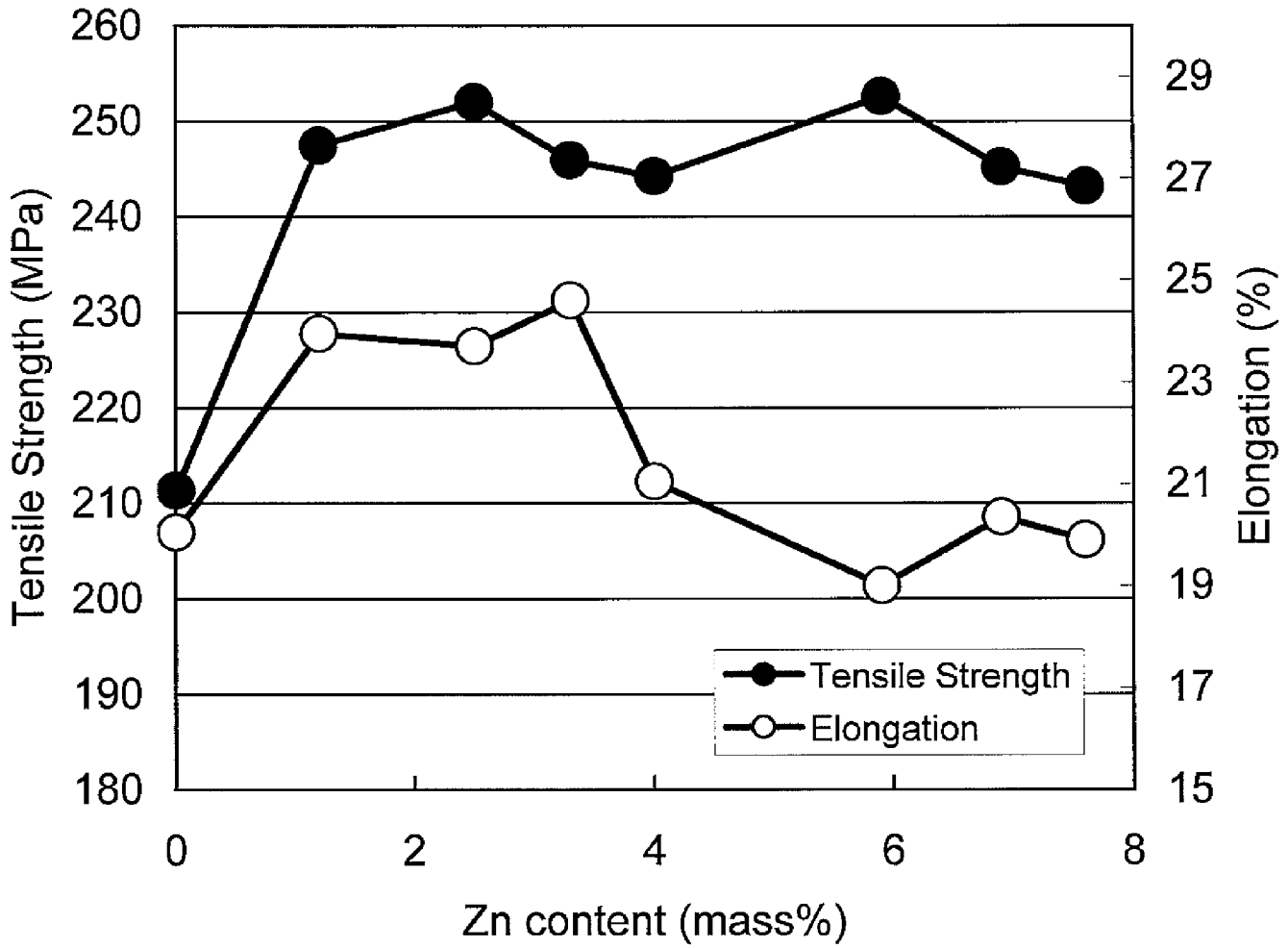
[FIG. 4] It is the graph showing relationship between the zinc content in the copper alloy and the mechanical property.
Figure 5:
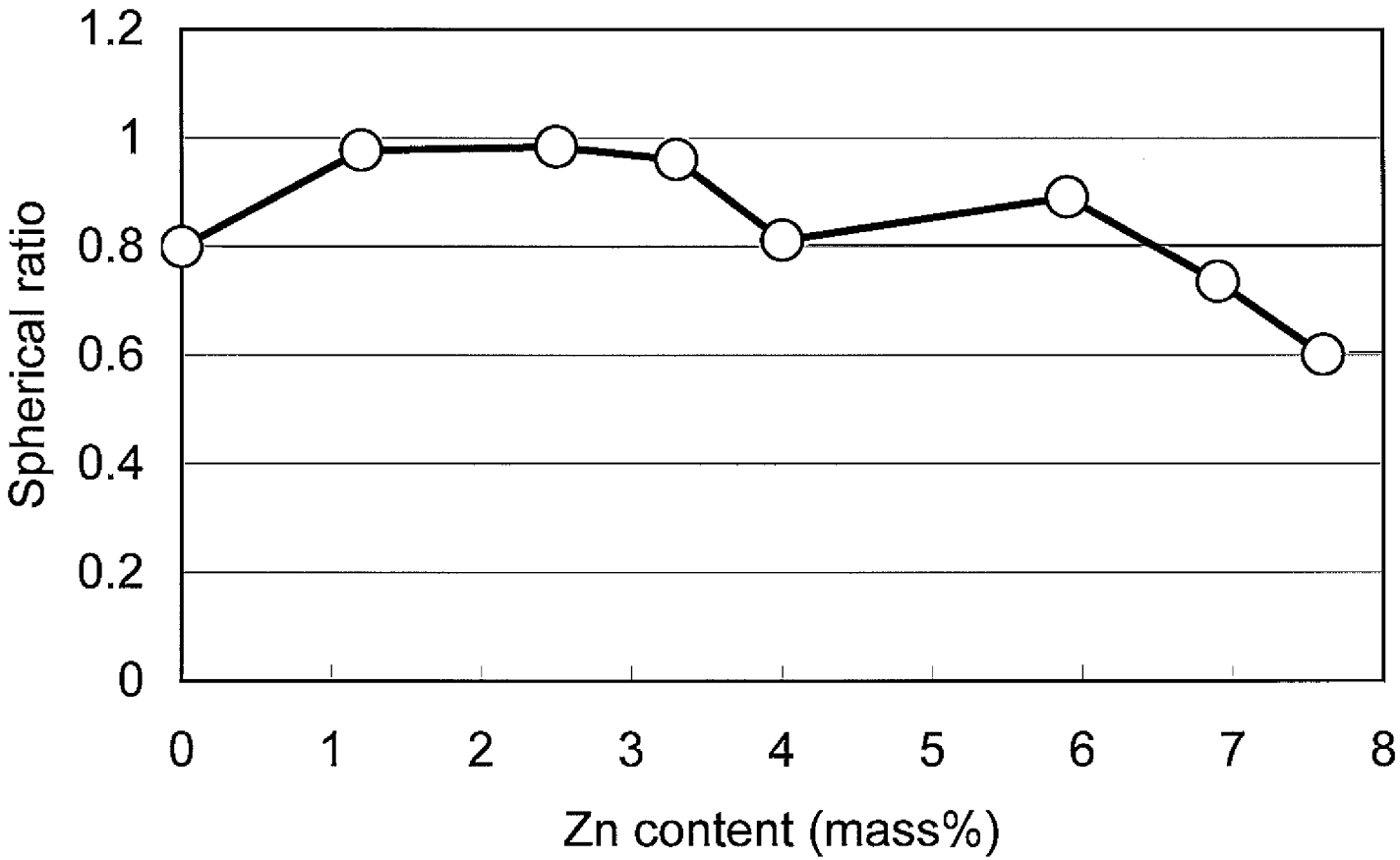
[FIG. 5] It is the graph showing relationship between the zinc content in the copper alloy and the spherical ratio.
Figure 7:
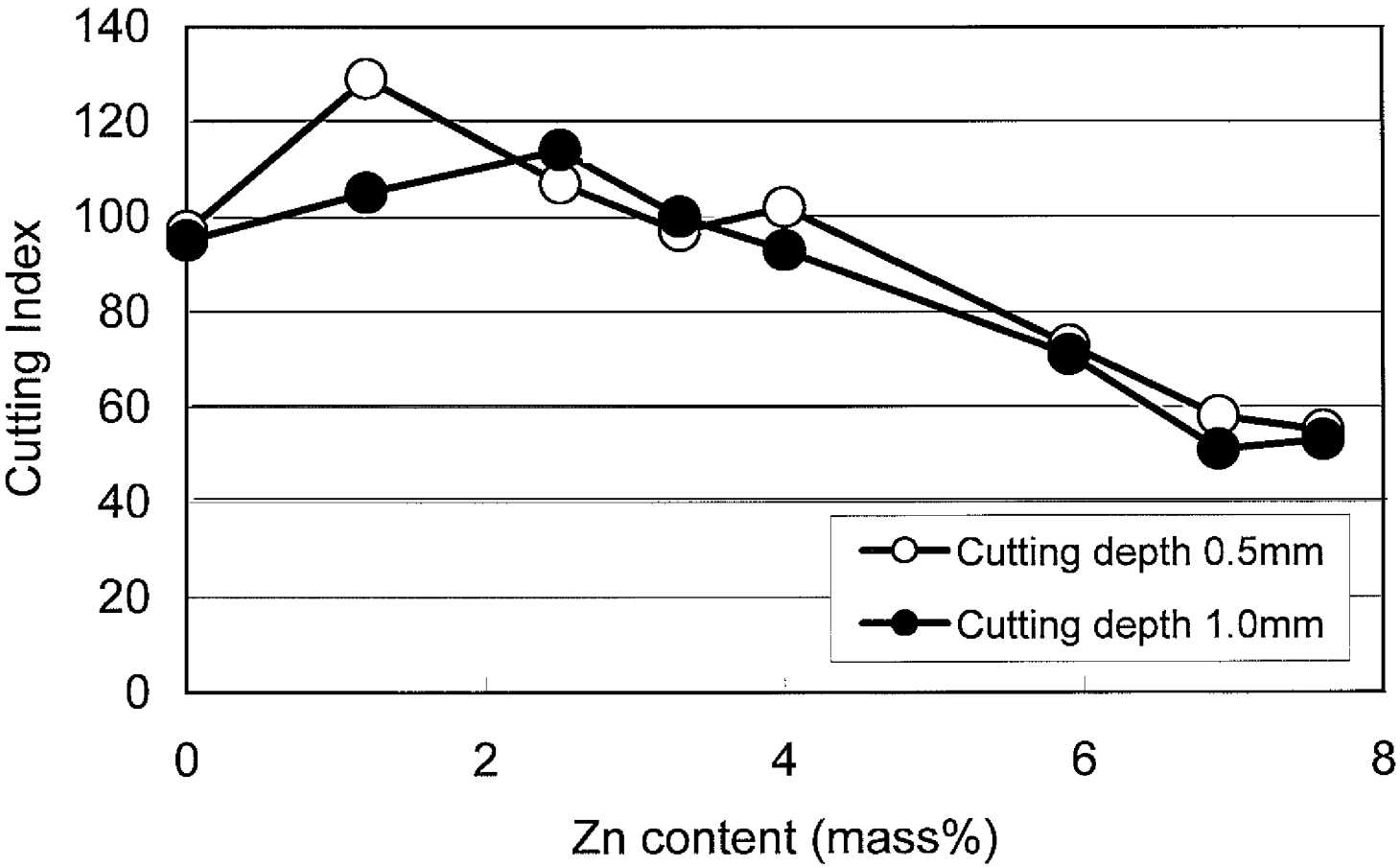
[FIG. 7] It is the graph showing relationship between the zinc content in the copper alloy and the machinability (cutting coefficient).
Figure 8:
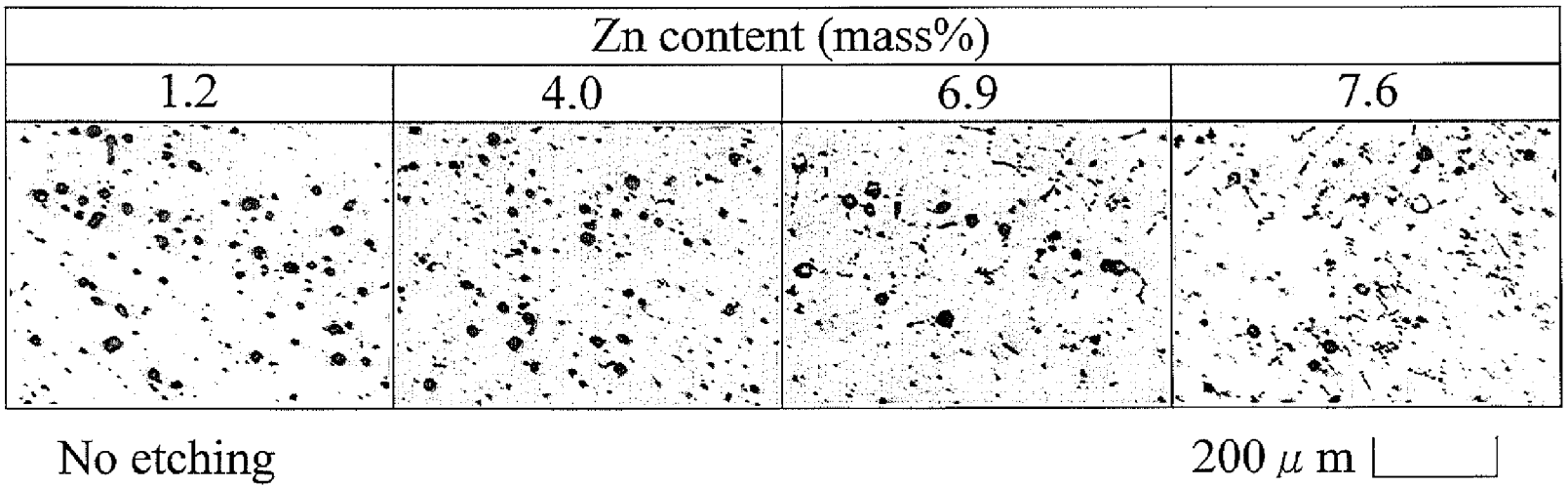
[FIG. 8] It is the microstructural photograph as a substitution of the graph showing microstructure in the various copper alloys of No. 8, No. 11, No. 13, and No. 14 in table 4.

The measured results (average of 2 results: n=2) were shown in Table 4. The relationship between the Zn content and the mechanical properties (tensile strength and elongation) of each copper alloy is shown in FIG. 4. The relationship between the Zn content and the spherical ratio is shown in FIG. 5. The relationship between the Zn content and the ratio of copper sulfide in all sulfides is shown in FIG. 6. The relationship between the Zn content and the machinability (the cutting index) is shown in FIG. 7.

TABLE 4

| No. | Tensile strength (MPa) | Elongation (%) | Average spherical ratio (—) | Area fraction of copper sulfide (%) |
|---|---|---|---|---|
| 7 | 211.4 | 20.1 | 0.63 | (100) |
| 8 | 247.5 | 24.0 | 0.86 | 89.4 |
| 9 | 252.0 | 23.7 | 0.85 | 84.6 |
| 10 | 246.0 | 24.6 | 0.81 | 77.5 |
| 11 | 244.2 | 21.1 | 0.78 | 67.6 |
| 12 | 252.6 | 19.0 | 0.78 | 37.6 |
| 13 | 245.2 | 20.4 | 0.76 | 11.4 |
| 14 | 243.2 | 19.9 | 0.72 | 9.6 |

It is considered from the results as follows. In 6% of the zinc content, the mechanical properties (tensile strength and elongation), the sulfide spherical ratio, the ratio of copper sulfide in all sulfides, and the machinability (the cutting index) are excellent. The optical microstructures (photograph of microstructure) of the samples containing 1.2%, 4.0%, 6.9% and 7.6% of Zn (No. 8, 11, 13, and 14) in the copper alloys shown above.

Example 5

Each copper alloy (No. 15-19) shown in Table 5 below was melted and cast by a common procedure. The mechanical properties (tensile strength and elongation) were examined.

TABLE 5

| | Chemical composition (mass %) | | | | | | | | |
|---|---|---|---|---|---|---|---|---|---|
| No. | Sn | Zn | Pb | Ni | Fe | P | Sb | S | Cu |
| 15 | 1.0 | 2.5 | <0.02 | 0.99 | 0.11 | 0.03 | <0.02 | 0.48 | Remainder |
| 16 | 1.9 | 2.4 | <0.02 | 0.99 | 0.05 | 0.03 | <0.02 | 0.47 | Remainder |
| 17 | 3.3 | 2.5 | <0.02 | 0.98 | 0.04 | 0.04 | <0.02 | 0.44 | Remainder |
| 18 | 4.9 | 2.4 | <0.02 | 0.96 | 0.04 | 0.04 | <0.02 | 0.47 | Remainder |
| 19 | 5.6 | 2.6 | <0.02 | 0.97 | 0.02 | 0.02 | <0.02 | 0.47 | Remainder |

Figure 9:
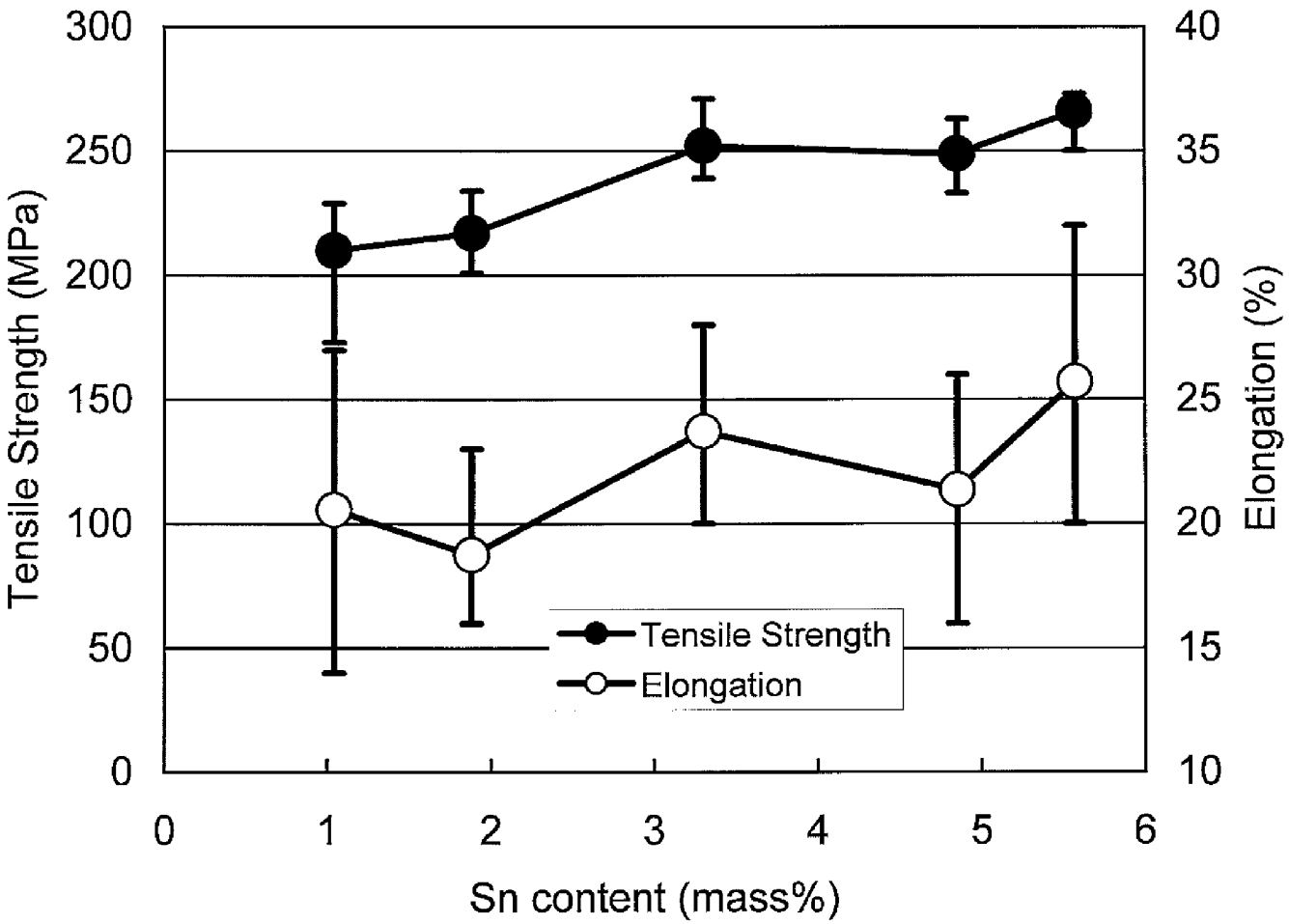
[FIG. 9] It is the graph showing relationship between the tin content in the copper alloy and the mechanical property.

The measured results are shown in Table 6 below. The relationship between the Sn content and the mechanical properties (tensile strength and elongation) (average of 2 results: n=2) of each copper alloy are shown in FIG. 9. As evidenced by the results, the tensile strength and the elongation increase with increasing Sn content.

TABLE 6

| No. | Tensile strength (MPa) | Elongation (%) | Average spherical ratio (—) | Area fraction of copper sulfide (%) |
|---|---|---|---|---|
| 15 | 210.0 | 20.6 | 0.87 | 82.6 |
| 16 | 216.9 | 18.8 | 0.80 | 80.5 |
| 17 | 252.9 | 23.7 | 0.85 | 84.6 |
| 18 | 248.8 | 21.4 | 0.85 | 77.4 |
| 19 | 265.9 | 25.7 | 0.83 | 67.1 |

INDUSTRIAL APPLICABILITY

The invention is described as above, and the sulfide which is shaped into spherical sulfide moderately in the copper matrix is dispersed effectively by controlling the contents of S, Sn, Zn, etc., and the copper alloy is of service as a material for a metallic water faucet, a water joint, etc. because the mechanical properties, the pressure toughness, and the machinability are excellent, even if lead, which pollutes water, is not contained. The invented alloy is also of service as a material for industrial parts, such as shaft bearing because the machinability is excellent.

The invention claimed is:

1. A lead free copper alloy for casting, consisting of:

0.1% to 0.7% (% means mass % in the case of component) of S,

8% or lower (not including 0%) of Sn, and

4% or lower (not including 0%) of Zn, wherein the remaining percent is copper, and unavoidable impurities, and wherein spherical sulfide with a spherical ratio of 0.7 or larger is dispersed in the lead free copper alloy.

2. The lead free copper alloy for casting of claim 1, wherein the area fraction of copper sulfide in all sulfides in the alloy is 70% or larger.

* * * * *